US005603312A

United States Patent [19]

Champion et al.

[11] Patent Number: 5,603,312

[45] Date of Patent: Feb. 18, 1997

[54] DIRECT VENT WOOD BURNING FIREPLACE

[75] Inventors: Mark R. Champion, Huntington, Ind.; Frank H. Broome, Columbia, Tenn.

[73] Assignee: The Majestic Products Company, Huntington, Ind.

[21] Appl. No.: 289,927

[22] Filed: Aug. 12, 1994

[51] Int. Cl.[6] ..... F24C 1/14

[52] U.S. Cl. ..... 126/77; 126/85 B; 126/193; 126/531; 126/523

[58] Field of Search ..... 126/85 B, 92 R, 126/77, 85 R, 527, 531, 515, 307 R, 518, 200, 193, 76, 60

[56] References Cited

U.S. PATENT DOCUMENTS

| | | | |
|---|---|---|---|
| 7,239 | 4/1850 | Gosnell . | |
| 2,322,016 | 6/1943 | Hardeman | 237/51 |
| 2,634,720 | 4/1953 | Thulman | 126/307 |
| 2,821,975 | 2/1958 | Thulman | 126/120 |
| 3,601,117 | 8/1971 | Carson | 126/121 |
| 3,724,443 | 4/1973 | Carson | 126/121 |
| 3,741,194 | 6/1973 | Herron | 126/85 B |
| 4,004,731 | 1/1977 | Zung | 237/51 |
| 4,163,440 | 8/1979 | Stultz | 126/200 |
| 4,285,326 | 8/1981 | Moss | 126/121 |
| 4,304,215 | 12/1981 | Jarman | 126/527 |
| 4,349,009 | 9/1982 | Patterson | 126/121 |
| 4,494,525 | 1/1985 | Albertson | 126/77 |
| 4,553,528 | 11/1985 | Wells | 126/123 |
| 4,793,322 | 12/1988 | Shimek | 126/80 |
| 5,092,313 | 3/1992 | Blackburn | 126/512 |
| 5,263,471 | 11/1993 | Shimek | 126/528 |
| 5,307,801 | 5/1994 | Schroeter | 126/515 |

FOREIGN PATENT DOCUMENTS

| | | | |
|---|---|---|---|
| 2675886 | 10/1992 | France | 126/515 |

*Primary Examiner*—James C. Yeung
*Attorney, Agent, or Firm*—Baker & Daniels

[57] ABSTRACT

The invention is directed to a balanced flue or direct vented, solid fuel burning fireplace which may be installed in a building and is operable at energy input levels greater than 75,000 BTU/hour. An enclosure including a top wall, bottom wall and four side walls defines a combustion chamber. At least one of the side walls includes an operable, sealed, transparent access door. A flue is connected to the enclosure and disposed in fluid communication with the combustion chamber and an outside ambient environment external to the building. A combustion air duct is connected to the enclosure and disposed in fluid communication with the combustion chamber and the outside ambient environment external to the building, whereby substantially all of the combustion air supplied to the combustion chamber flows through the combustion air duct when the access door is in a closed position.

54 Claims, 3 Drawing Sheets

DIRECT VENT WOOD BURNING FIREPLACE

BACKGROUND OF THE INVENTION

1. Field of the Invention

The present invention relates to fireplaces, and, more particularly, to direct vent wood burning fireplaces.

2. Description of the Related Art

Direct vent fireplaces are typically used for gas fireplace applications. A combustion air duct provides combustion air from an outside ambient environment to the combustion chamber at a location which is at or below the base of the fire within the combustion chamber. When the gas burner is ignited a natural draft is created within the flue pipe which causes a low pressure area below the fire and pulls the combustion air through the combustion air duct into the combustion chamber. An access door disposed in one wall of the combustion chamber may be sealed with the framework of the fireplace to ensure that an adequate siphon affect occurs within the combustion chamber to draw the combustion air through the combustion air duct and into the combustion chamber.

Gas fireplaces have a relatively low heat input and volumetric flow rate of combustion products when compared to a conventional wood burning fireplace. For example, a conventional gas fireplace has a predetermined supply of gas (such as by a fixed orifice) which is fed to the burner and may be selectively turned on or off. The predetermined supply of gas has an energy input of between 20,000–40,000 BTU/hour, which in turn results in an operating temperature at the inlet to the flue of about 600° F., and does not exceed 1000° F. for conventional units. A fire in a gas fireplace having an energy input level of only 20,000–40,000 BTU/hour in turn results in a lesser demand for combustion air into the combustion chamber. As a result, a direct vented gas fireplace may receive all of the required combustion air through the combustion air duct.

Solid fuel, e.g., wood, burning fireplaces may include a combustion air duct which provides combustion air from the outside ambient environment to the interior of the combustion chamber. However, with conventional units, the combustion air duct does not supply all of the combustion air required for proper combustion within the fireplace. To wit, in contrast with a gas fireplace which may typically have an energy input of, e.g., 20,000–40,000 BTU/hour, a wood burning fireplace has an energy input which begins near zero and may approach 250,000 BTU/hour during operation, or even greater. Such an energy input in turn requires a much larger supply of combustion air into the combustion chamber for proper combustion. Wood burning fireplaces having a combustion air duct do not receive a sufficient amount of combustion air through the combustion air duct for proper combustion. Rather, combustion air is utilized from both the outside ambient environment and the room in which the fireplace is located.

Wood burning fireplaces of conventional design may include a glass door at the front of the fireplace, but the door is not sealed with the combustion chamber and a portion of the combustion air used within the combustion chamber is drawn into the combustion chamber from the room in which the fireplace is located. In fact, glass access doors for a wood burning fireplace are purposefully designed to effect a flow of combustion air into the combustion chamber from the room in which the fireplace is located. Wood burning fireplaces therefore use a substantial amount of combustion air from the room in which the fireplace is located, with attendant disadvantages associated therewith, e.g., negative pressure and indoor air quality problems.

More specifically, newer homes in which a fireplace is located are built fairly air-tight to conserve energy costs associated with heating and cooling. However, products placed within the house such as a water heater or furnace may utilize some of the air within the house as combustion air. This may cause a negative ambient pressure within the home, relative to the outside ambient environment. A wood burning fireplace which uses combustion air from the room in which the fireplace is located also contributes to the negative pressure problem within the house. A negative pressure within the house will cause cold air from the outside ambient environment to flow into the house through various openings, e.g., bathroom vents, chimneys, etc., resulting in a loss of overall energy efficiency.

Further, in contrast with a gas fireplace which is instantaneously turned off by stopping the flow of gas to the burner, a wood burning fireplace has a burn-down period in which the fire continues to smolder within the combustion chamber. When the fire is smoldering, the heat output of the fire is relatively small and there is only a small natural draft which occurs through the flue pipe. Because of negative pressure which may exist within the house, combustion products may flow from the combustion chamber past the non-sealed door and into the room in which the fireplace is located. That is, the lower pressure within the room in which the fireplace is located (relative to the interior of the combustion chamber or to the outside atmosphere), may cause combustion products produced by the smoldering fire to flow into the room. Discharge of such combustion products into the house is obviously not desirable.

What is needed in the art is a wood burning fireplace which provides all of the necessary combustion air to the combustion chamber from the outside ambient environment, and does not utilize combustion air from the room in which the fireplace is located.

A further need is a wood burning fireplace which supplies all of the combustion air from the outside ambient environment without utilizing combustion air from the room in which a fireplace is located, while at the same time providing sufficient combustion air to the combustion chamber for a solid fuel energy input of greater than 75,000 BTU/hour.

A further need is a direct vent wood burning fireplace which may introduce the combustion air at the top of the combustion chamber (e.g., above the base of the fire), and does not require the use of ducting, plenums, etc. having a long flow path for introducing the combustion air at the bottom of the combustion chamber in one of the side walls or the bottom wall.

SUMMARY OF THE INVENTION

The present invention provides a direct vented, solid fuel burning fireplace which provides substantially all of the combustion air to the combustion chamber from an outside ambient environment, and does not use combustion air from the room in which the fireplace is located when the access door is in a closed position (ignoring minor seal leakage around the access door).

The invention comprises, in one form thereof, a direct vented, solid fuel burning fireplace which may be installed in a building and is operable at energy input levels greater than 75,000 BTU/hour. An enclosure including a top wall, bottom wall and four side walls defines a combustion chamber. At least one of the side walls includes an openable, sealed, transparent access door. A flue is connected to the enclosure and disposed in fluid communication with the combustion chamber and an outside ambient environment external to the building. A combustion air duct is connected to the enclosure and disposed in fluid communication with the combustion chamber and the outside ambient environment external to the building, whereby substantially all of the combustion air supplied to the combustion chamber flows through the combustion air duct when the access door is in a closed position.

An advantage of the present invention is that substantially all of the combustion air is provided to the combustion chamber from the outside ambient environment.

Another advantage is that the fireplace of the present invention may receive relatively large energy input levels, e.g., exceeding 75,000 BTU/hour, while at the same time using substantially all of the necessary combustion air from the outside ambient environment.

A still further advantage is that the combustion air may be introduced at or near the top of the combustion chamber, without the need for extensive duct work, etc. to introduce the combustion air near the bottom of the combustion chamber.

Yet another advantage is that the fireplace of the present invention is designed to operate properly with the access door open or with the access door closed, although the closed door position is preferred.

BRIEF DESCRIPTION OF THE DRAWINGS

The above-mentioned and other features and advantages of this invention, and the manner of attaining them, will become more apparent and the invention will be better understood by reference to the following description of an embodiment of the invention taken in conjunction with the accompanying drawings, wherein.

Corresponding reference characters indicate corresponding parts throughout the several views. The exemplification set out herein illustrates one preferred embodiment of the invention, in one form, and such exemplification is not to be construed as limiting the scope of the invention in any manner.

DETAILED DESCRIPTION OF THE INVENTION

Figure 1:
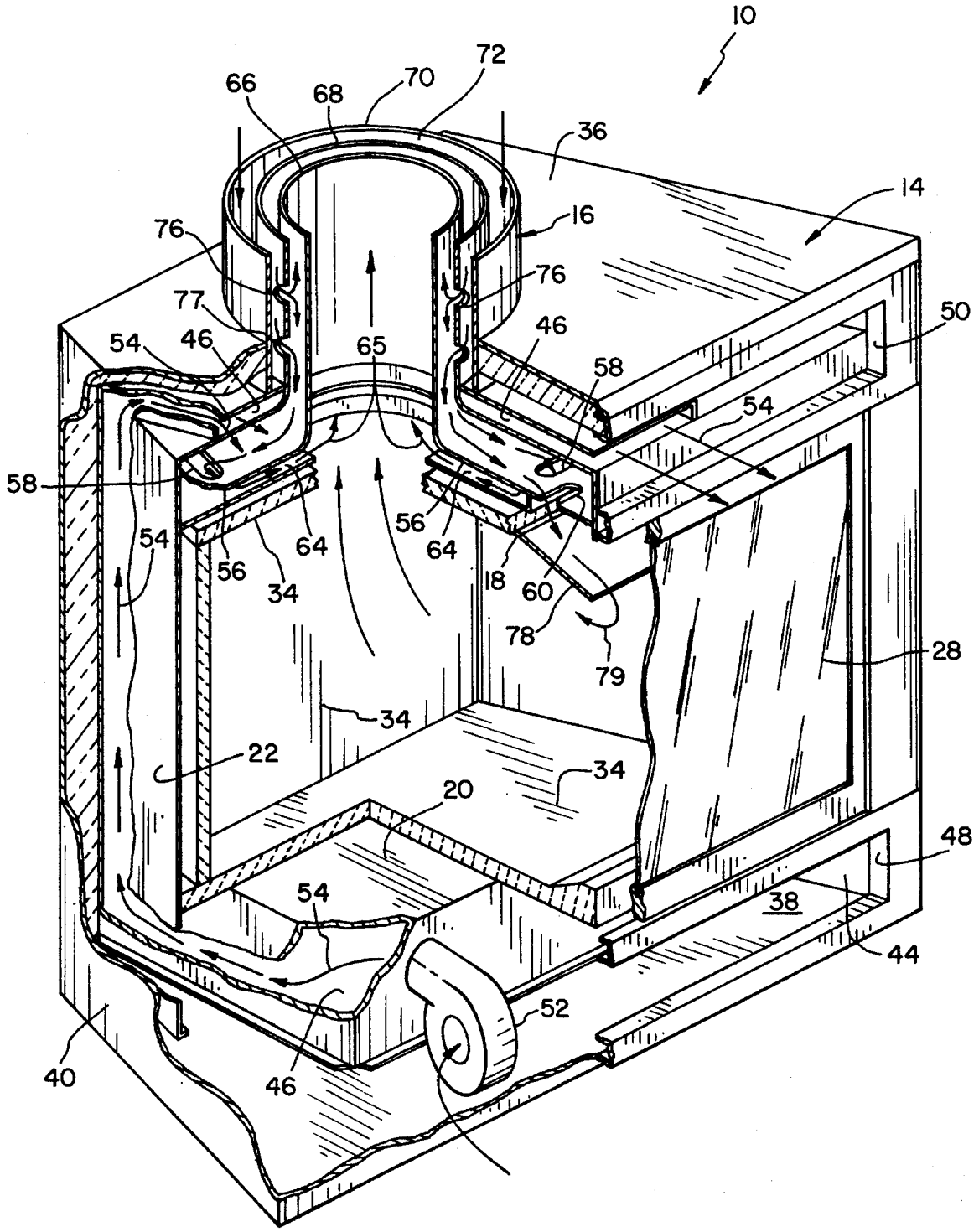
FIG. 1 is a perspective view of one embodiment of the present invention.
Figure 2:
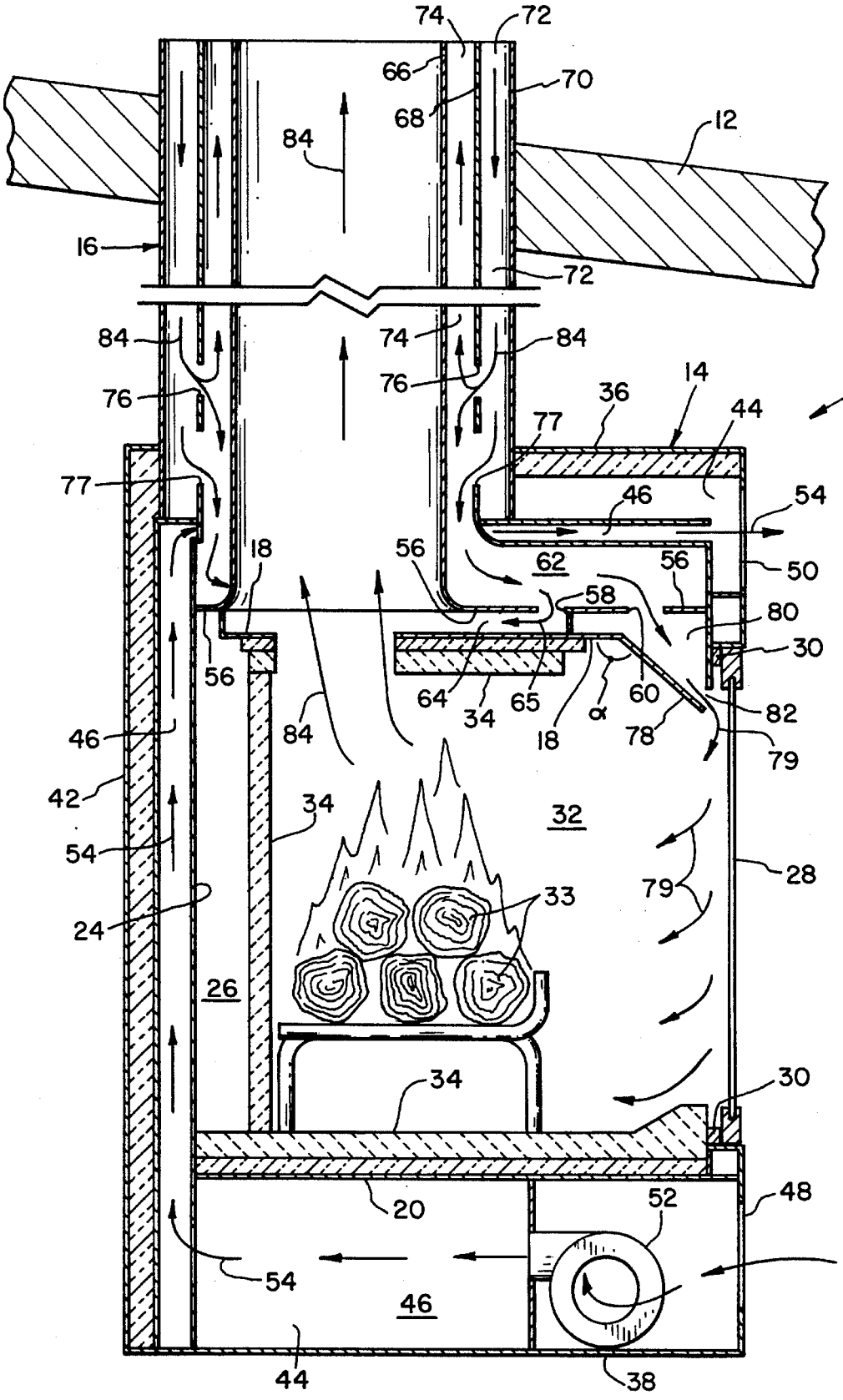
FIG. 2 is a side sectional view of the embodiment shown in FIG. 1, with a flue assembly thereof shown extending through a roof line.

Referring now to the drawings, and more particularly to FIGS. 1 and 2, there is shown one embodiment of a fireplace 10 of the present invention which is adapted to be installed within a building and may extend through a roof 12 of the building (FIG. 2) to an outside ambient environment external to the building. Fireplace 10 is a balanced flue, sealed combustion fireplace and includes an enclosure 14 connected to a flue assembly 16. Fireplace 10 is adapted to receive a solid fuel, such as wood logs 33, which may provide an energy input rate ranging from near zero to 250,000 BTU/hour, or even greater. In contrast with a conventional gas fireplace having an energy input level which is typically between 20,000–40,000 BTU/hour (with associated combustion air requirements), wood logs 33 placed within fireplace 10 of the present invention normally provide input energy in a steady state condition at above 75,000 BTU/hour, with greatly increased combustion air requirements associated therewith.

Enclosure 14 includes a top wall 18, bottom wall 20, and sidewalls 22, 24, 26, and 28. Sidewall 28 is shown in the form of an openable, e.g. hinged, transparent access door forming a sealed interconnection with enclosure 14 via seals 30 when in a closed position (FIG. 2). Access door 28 is operable between the closed position as shown, and an open position (not shown) for loading of wood logs 33 therein. Top wall 18, bottom wall 20 and sidewalls 22–28 define a combustion chamber 32 therein for receiving a load of solid fuel, such as wood logs 33. Also disposed within combustion chamber 32 are refractory elements 34.

Enclosure 14 also includes an outer housing defined by an outer top wall 36, an outer bottom wall 38 and outer sidewalls 40, 42, and 44. Disposed between outer housing 36–44 and combustion chamber 32 is a room air circulation channel 46 having an inlet 48 and an outlet 50. A blower 52 is disposed within room air circulation channel 46 and effects a flow of air therethrough (as indicated by directional arrows 54) which is exhausted at outlet 50 at an elevated temperature relative to inlet 48.

Disposed between outer top wall 36 and top wall 18 is an intermediate top wall 56 having a plurality of apertures 58, 60 formed therein. A plenum 62 is defined in part by intermediate top wall 56 and is disposed between intermediate top wall 56 and outer top wall 36. Apertures 58 are disposed in fluid communication with a plenum 64 defined by and disposed between top wall 18 and intermediate top wall 56. Plenum 64 exhausts to the inlet of flue assembly 16. Apertures 60 are in communication with and provide combustion air to combustion chamber 32.

Flue assembly 16 includes an inner pipe 66, intermediate pipe 68 disposed around inner pipe 66, and an outer pipe 70 disposed around intermediate pipe 68. Outer pipe 70 and intermediate pipe 68 define an annular duct 72 therebetween which is adapted to be in fluid communication with the outside ambient environment external to building 12. Likewise, intermediate pipe 68 and inner pipe 66 define a cooling air duct 74 which is in fluid communication with the outside ambient environment external to building 12. In the embodiment shown, inner pipe 66 has a diameter of eight inches, intermediate pipe 68 has a diameter of 11 inches, and outer pipe 70 has a diameter of 13.5 inches.

Figure 4:
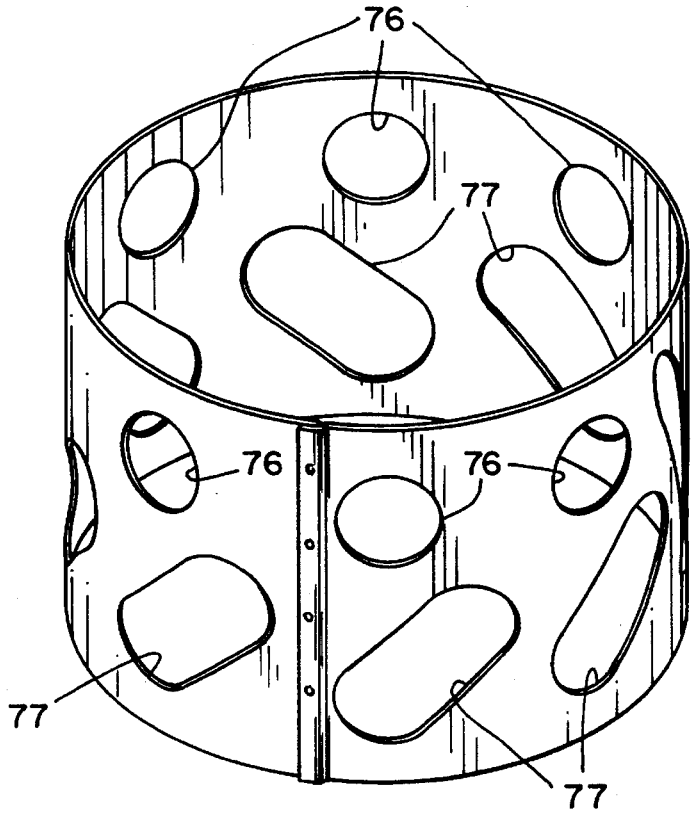
FIG. 4 is a perspective view of an embodiment of an intermediate pipe of a flue assembly of the present invention.

Referring now to FIGS. 1 and 4, intermediate pipe 68 includes a plurality of apertures 76, 77 therein for allowing combustion air to flow from annular duct 72 into cooling air duct 74 and plenum 62. More particularly, intermediate pipe 68 includes apertures 76, 77 (eight each) having a total cross-sectional area of about 82 in.$^2$. Apertures 76 each consist of a two inch diameter circle, and apertures 77 each consist of an elongated slot having dimensions of two (2) inches by four (4) inches. It is to be understood, however, that the specific configuration of apertures 76, 77 may vary.

Figure 3:
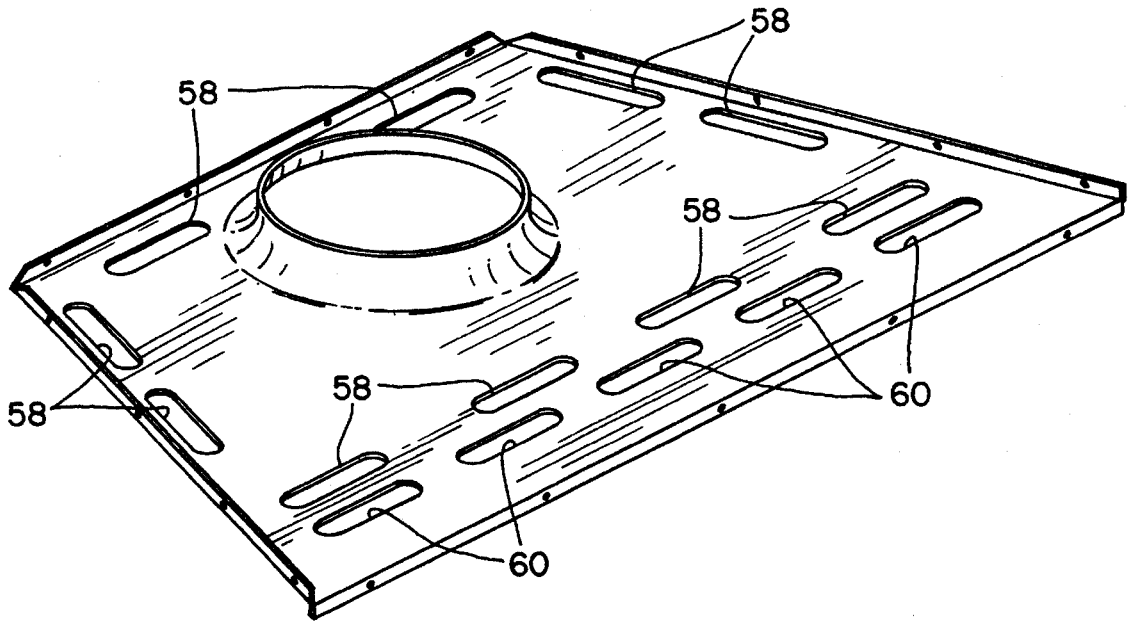
FIG. 3 is a perspective view of an embodiment of an intermediate top wall of the present invention.

Referring now to FIGS. 1–3, intermediate top wall 56 will be described in greater detail. Openings 58 are disposed in fluid communication with plenum 64 and together form an air wash for drawing relatively cool air across the top of the combustion chamber and into inner pipe 66 of flue assembly 16 for cooling thereof. Because plenum 64 is in communication with the inlet to inner pipe 66, the natural draft within inner pipe 66 "pulls" air from plenum 62 and thereby assists in assuring an adequate flow of combustion air through annular duct 72 and into plenum 62. In the embodiment shown, ten (10) openings 58 are disposed in fluid communication with plenum 64 and have a total cross sectional area of 39.1 in.$^2$. Moreover, five (5) openings 60 are exposed in fluid communication with an interior of combustion chamber 32 for providing combustion air therein. Openings 60 have a cross sectional area of 19.6 in.$^2$ in the embodiment shown.

Referring now to FIGS. 1 and 2, a diverter plate 78 is shown as being integrally attached to top wall 18. Diverter plate 78 and intermediate top wall 56 define a chamber 80 therebetween. Diverter plate 78 is spaced from front wall 28 and defines a slot-shaped combustion air inlet 82 therebetween. Diverter plate 78 is disposed at an obtuse angle alpha ($\alpha$) relative to top wall 18.

Annular duct 72, apertures 76, 77, plenum 62, chamber 80 and combustion air inlet 82 define a combustion air duct for supply combustion air from the outside ambient environment to combustion chamber 32.

In operation, sealed access door 28 is opened and wood logs 33 are placed within combustion chamber 32 and ignited to produce a relatively high energy input rate, which is most probably above 75,000 BTU/hour after initial start up. Access door 28 is moved to a closed position, such as shown in FIG. 2, whereby seals 30 engage enclosure 14 and form a seal therewith. The flow of combustion products up inner pipe 66, as indicated by directional arrows 84, causes combustion air to be pulled in a downward direction through annular duct 72. More particularly, the natural draft occurring within inner pipe 66 causes a low pressure within plenum 64 and combustion air inlet 82 which in turn pulls combustion air through annular duct 72, apertures 76 and plenum 62. A portion of the air within plenum 62 flows through openings 58 and plenum 64 into inner pipe 66, as indicated by directional arrows 65, while the remainder of the combustion air within plenum 62 is drawn in to chamber 80 and through combustion air inlet 82 into combustion chamber 32, as indicated by directional arrows 79. As indicated by directional arrow 84, a portion of the combustion air flowing through annular duct 72 flows into plenum 62, while a last remaining portion of combustion air flowing through combustion air duct and openings 76 flows in a vertically upward direction through cooling air duct 74 and back into the outside ambient environment external to building 12. The hot combustion products flowing through inner pipe 66 causes a natural draft within cooling air duct 74 which assists in effecting a flow of cooling air therethrough.

In the embodiment shown in the drawings, seals 30 provide an effective seal whereby substantially all of the combustion air supplied to the combustion chamber enters the combustion chamber through the combustion air duct, and does not flow past the doors from the room in which the fireplace is located. For example, when a negative pressure of 0.10 inches of water is created at the center of the combustion chamber, the fireplace shown in the drawings has a leakage rate past the door seals of about 17.5 cubic feet per minute (CFM) at standard ambient conditions. Such a leakage rate corresponds to about a 15% leakage through the front door. That is, about 85% of the combustion air is supplied through the combustion air duct and about 15% flows past the sealed door. In contrast, an unsealed wood-burning fireplace may draw combustion air from the room in which the fireplace is located at a rate of up to 200 CFM. Seals 30 of the present invention are therefore configured whereby a leakage rate past the sealed door into the combustion chamber at a negative pressure of 0.10 inch water is between 0 and 35 CFM, preferably 0 and 20 CFM, more preferably 10 and 20 CFM, and most preferably about 17.5 CFM. At a leakage rate of 35 CFM, approximately 30% of the combustion air is drawn past the sealed door and into the combustion chamber.

The present invention provides a balanced flue, sealed combustion wood burning fireplace which utilizes all of the necessary combustion air from the outside ambient environment external to the building in which the fireplace is located and which does not utilize any appreciable amount of air from the room in which the fireplace is located. The fireplace of the present invention therefore does not contribute to problems such as negative pressure and pollution within the room in which the fireplace is located. Thus, in contrast with conventional solid fuel burning fireplaces which require at least some of the combustion air to be used from the room in which the fireplace is located, the present invention provides substantially all of the combustion air from the outside ambient environment. Moreover, the present invention provides a plenum at the top of the combustion chamber and a cooling air duct adjacent the inner pipe of the flue assembly which each utilize a portion of the relatively cool combustion air to cool the top of the combustion chamber and the inner pipe of the flue assembly, respectively.

While this invention has been described as having a preferred design, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. A direct vented, solid fuel burning fireplace operable at energy input levels greater than 75,000 BTU/hour, said fireplace installed in a building, and comprising:

an enclosure including a top wall, bottom wall and four side walls defining a combustion chamber, at least one of said side walls including an openable, sealed, transparent access door;

a seal disposed between said access door and the combustion chamber;

a flue connected to said enclosure and disposed in fluid communication with said combustion chamber and an outside ambient environment external to the building; and a combustion air duct connected to said enclosure and disposed in fluid communication with said combustion chamber and the outside ambient environment external to the building, wherein said seal causes substantially all combustion air supplied to said combustion chamber to flow through said combustion air duct when said access door is in a closed position.

2. The fireplace of claim 1, further comprising an outer pipe around said flue, said combustion air duct disposed between said outer pipe and said flue.

3. The fireplace of claim 2, further comprising an intermediate pipe disposed between said outer pipe and said flue, said intermediate pipe and one of said outer pipe and said flue defining said combustion air duct therebetween.

4. The fireplace of claim 3, wherein said intermediate pipe and said outer pipe define said combustion air duct therebetween.

5. The fireplace of claim 1, wherein said top wall includes a plurality of openings therein, said combustion air duct in fluid communication with said openings.

6. The fireplace of claim 1, further comprising a first plenum having an outlet disposed at or near an interior of said flue and a second plenum having an outlet disposed at a top of said combustion chamber, each of said first and second plenums fluidly connected to said combustion air duct.

7. The fireplace of claim 6, wherein said first plenum constitutes a means for inducing a flow of combustion air through said combustion air duct.

8. The fireplace of claim 7, wherein said first plenum induces a flow of combustion air through said combustion air duct, dependent on a flow rate of combustion products through said flue.

9. The fireplace of claim 6, wherein said first plenum outlet is disposed at an inlet to said flue.

10. The fireplace of claim 1, wherein said sealed access door allows a flow of combustion air into said combustion chamber and past said sealed access door at a rate of about 17.5 cubic feet per minute at a negative pressure of 0.10 inch of water within said combustion chamber.

11. The fireplace of claim 1, wherein said sealed access door allows a flow of combustion air into said combustion chamber and past said sealed access door at a rate of between 0 and 35 cubic feet per minute at a negative pressure of 0.10 inch of water within said combustion chamber.

12. The fireplace of claim 1, wherein said sealed access door allows a maximum of 15 percent of a total amount of combustion air flowing into said combustion chamber to flow past said sealed access door.

13. The fireplace of claim 1, wherein said sealed access door allows a maximum of 30 percent of a total amount of combustion air flowing into said combustion chamber to flow past said sealed access door.

14. A direct vented, solid fuel burning fireplace operable at energy input levels greater than 75,000 BTU/hour, said fireplace installed in a building, and comprising:

an enclosure including a top wall, bottom wall and four side walls defining a combustion chamber at least one of said side walls including an openable, sealed, transparent access door, said top wall including a plurality of openings therein;

a flue connected to said enclosure and disposed in fluid communication with said combustion chamber and outside ambient environment external to the building; and a combustion air duct connected to said enclosure and disposed in fluid communication with said combustion chamber, said plurality of openings, and the outside ambient environment external to the building, wherein substantially all combustion air supplied to said combustion chamber flows through said combustion air duct once said access door is in a closed position and some of said plurality of top wall openings are fluidly connected to said combustion chamber and carry combustion air to said combustion chamber and a remainder of said plurality of top wall openings are fluidly connected to an interior of said flue such that combustion air is drawn up said flue.

15. A direct vented, solid fuel burning fireplace operable at energy input levels greater than 75,000 BTU/hour, said fireplace installed in a building, and comprising:

an enclosure including a top wall, bottom wall and four side walls defining a combustion chamber, at least one of said side walls including an openable, sealed, transparent access door, said top wall including a plurality of openings;

a flue connected to said enclosure and disposed in fluid communication with said combustion chamber and outside ambient environment external to the building;

a combustion air duct connected to said enclosure and disposed in fluid communication with said combustion chamber and the outside ambient environment external to the building; and a first plenum having an outlet disposed at or near an interior of said flue and a second plenum having an outlet disposed at the top of said combustion chamber, each of said first and second plenums fluidly connected to said combustion air duct, said first plenum disposed below and in fluid communication with a portion of said top wall openings and said second plenum disposed below and in fluid communication with a remainder of said top wall openings, wherein substantially all combustion air supplied to said combustion chamber flows through said combustion air duct when said access door is in a closed position.

16. A direct vented, solid fuel burning fireplace operable at energy input levels greater than 75,000 BTU/hour, comprising:

an enclosure including a top wall, bottom wall and four side walls defining a combustion chamber, at least one of said side walls including an openable, sealed, transparent access door;

a seal disposed between said access door and the combustion chamber;

a flue assembly including an inner pipe and an outer pipe disposed around said inner pipe, said flue assembly defining an annular combustion air duct therein, said inner pipe connected to said enclosure and disposed in fluid communication with said combustion chamber, said inner pipe adapted for conveying combustion products from said combustion chamber to an outside ambient environment, said combustion air duct connected to one of said top wall, bottom wall and side walls, said combustion air duct disposed in fluid communication with said combustion chamber and adapted to be disposed in fluid communication with the outside ambient environment, said seal causing substantially all combustion air supplied to said combustion chamber to flow through said combustion air duct when said access door is in a closed position.

17. The fireplace of claim 16, wherein said flue assembly includes an intermediate pipe disposed between said inner pipe and said outer pipe, said intermediate pipe and one of said inner pipe and said outer pipe defining said combustion air duct therebetween.

18. The fireplace of claim 17, wherein said intermediate pipe and said outer pipe define said combustion air duct therebetween, and wherein said intermediate pipe includes a plurality of apertures therein.

19. The fireplace of claim 18, further comprising means disposed in fluid communication with said apertures for transporting combustion air from said combustion air duct and said apertures into said combustion chamber.

20. The fireplace of claim 19, wherein said inner pipe and said intermediate pipe define a cooling air duct disposed therebetween and in fluid communication with the outside ambient environment, said transporting means for receiving a portion of the combustion air and said cooling air duct for receiving a remainder of the combustion air.

21. The fireplace of claim 19, wherein said enclosure includes an outer housing disposed around said combustion chamber and having an outer top wall, said transporting means disposed between said top wall and said outer top wall.

22. The fireplace of claim 16, wherein said enclosure includes an outer housing disposed around said combustion chamber, said outer housing and said top wall, bottom wall and at least one of said side walls defining a room air circulation channel therebetween.

23. A direct vented, solid fuel burning fireplace operable at energy input levels greater than 75,000 BTU/hour, comprising:

an enclosure including a top wall, bottom wall and four side walls defining a combustion chamber, at least one of said side walls including an openable, sealed, transparent access door, and an outer housing disposed around said combustion chamber and having an outer top wall;

a flue assembly including an inner pipe, an outer pipe disposed around said inner pipe, and an intermediate pipe disposed between said inner pipe and said outer pipe, said outer pipe and said intermediate pipe defining said combustion air duct therebetween, said intermediate pipe including a plurality of apertures therein, said inner pipe connected to said enclosure and disposed in fluid communication with said combustion chamber, said inner pipe adapted for conveying combustion products from said combustion chamber to an outside ambient environment, said combustion air duct connected to one of said top wall, bottom wall and side walls, said combustion air duct disposed in fluid communication with said combustion chamber and adapted to be disposed in fluid communication with the outside ambient environment, whereby substantially all combustion air supplied to said combustion chamber flows through said combustion air duct when said access door is in a closed position;

means disposed in fluid communication with said apertures for transporting combustion air from said combustion air duct and said apertures into said combustion chamber, said transporting means disposed between said top wall and said outer top wall; and an intermediate top wall disposed between said top wall and outer top wall, said intermediate top wall including a plurality of openings therein disposed in fluid communication with said combustion chamber, said transporting means comprising said openings and a plenum disposed between said outer top wall and said intermediate top wall.

24. The fireplace of claim 23, further comprising a diverter plate extending across a width of said combustion chamber and having at least a portion thereof which is spaced from said combustion chamber front wall to define a combustion air inlet therebetween.

25. The fireplace of claim 24, wherein said combustion air inlet comprises a slot defined between said diverter plate and said combustion chamber front wall, and wherein said diverter plate is disposed at an obtuse angle to said combustion chamber top wall, whereby combustion products are directed towards said inner pipe of said flue pipe assembly.

26. A direct vented, solid fuel burning fireplace, comprising:

an enclosure including a top wall, bottom wall and four side walls defining a combustion chamber, at least one of said side walls including an openable, sealed, transparent access door;

a seal disposed between said access door and the combustion chamber;

a flue connected to said enclosure, said flue disposed in fluid communication with said combustion chamber and adapted to be disposed in fluid communication with an outside ambient environment; and a combustion air duct connected to said enclosure top wall, said combustion air duct disposed in fluid communication with said combustion chamber and adapted to be disposed in fluid communication with the outside ambient environment.

27. The fireplace of claim 26, wherein said combustion chamber top wall includes a combustion air inlet connected to said combustion air duct, said combustion air inlet disposed above said access door, whereby combustion air which flows into said combustion chamber cools said access door.

28. The fireplace of claim 27, further comprising an outer pipe disposed around said flue, said combustion air duct at least partially defined by one of said outer pipe and said flue and disposed between said outer pipe and said flue.

29. A direct vented, solid fuel burning fireplace, comprising:

an enclosure including a top wall, bottom wall and four side walls defining a combustion chamber, at least one of said side walls including an openable, sealed, transparent access door, said combustion chamber including a combustion air inlet disposed in one of said top wall and said side walls at a location which is in an upper one-half of said combustion chamber;

a seal disposed between said access door and the combustion chamber;

a flue connected to said enclosure, said flue disposed in fluid communication with said combustion chamber and adapted to be disposed in fluid communication with an outside ambient environment; and a combustion air duct connected to said enclosure, said combustion air duct disposed in fluid communication with said combustion air inlet and adapted to be disposed in fluid communication with the outside ambient environment.

30. The fireplace of claim 29, further comprising an intermediate pipe disposed around said inner pipe and an outer pipe disposed around said intermediate pipe, said intermediate pipe and one of said inner pipe and said outer pipe defining said combustion air duct therebetween.

31. The fireplace of claim 30, wherein said intermediate pipe and said outer pipe define said combustion air duct therebetween, and wherein said intermediate pipe includes a plurality of apertures.

32. The fireplace of claim 31, further comprising means disposed in fluid communication with said apertures for transporting combustion air from said combustion air duct and said apertures into said combustion chamber.

33. The fireplace of claim 32, wherein said inner pipe and said intermediate pipe define a cooling air duct disposed therebetween and in fluid communication with the outside ambient environment, said transporting means for receiving a portion of the combustion air and said cooling air duct for receiving a remainder of the combustion air.

34. The fireplace of claim 32, wherein said enclosure includes an outer housing disposed around said combustion chamber and including an outer top wall, said transporting means disposed between said top wall and said outer top wall.

35. The fireplace of claim 29, wherein said enclosure includes an outer housing disposed around said combustion chamber, said outer housing and said top wall, bottom wall and at least one of said side walls defining a room air circulation channel therebetween.

36. The fireplace of claim 29, wherein said combustion air inlet is disposed in one of said top wall and said side walls at a location which is in an upper one-third of said combustion chamber.

37. A direct vented solid fuel burning fireplace comprising:

an enclosure including a top wall, bottom wall and four side walls defining a combustion chamber, at least one of said side walls including an openable, sealed, transparent access door, said combustion chamber including a combustion air inlet disposed in one of said top wall and said side walls at a location which is in an upper one-half of said combustion chamber, said enclosure further including an outer housing disposed around said combustion chamber and including an outer top wall;

a flue connected to said enclosure said flue disposed in fluid communication with said combustion chamber and adapted to be disposed in fluid communication with an outside ambient environment; and a combustion air duct connected to said enclosure, said combustion air duct disposed in fluid communication with said combustion air inlet and adapted to be disposed in fluid communication with the outside ambient environment;

an intermediate pipe disposed around said flue and an outer pipe disposed around said intermediate pipe, said intermediate pipe and said outer pipe defining said combustion air duct therebetween, said intermediate pipe including a plurality of apertures;

means disposed in fluid communication with said apertures for transporting combustion air from said combustion air duct and said apertures into said combustion chamber, said transporting means disposed between said top wall and said outer top wall; and an intermediate top wall disposed between said top wall and said outer top wall, said intermediate top wall including a plurality of openings therein disposed in fluid communication with said combustion chamber, said transporting means comprising said openings and a plenum disposed between said outer top wall and said intermediate top wall.

38. The fireplace of claim 37, further comprising a diverter plate extending across a width of said combustion chamber and having at least a portion thereof which is spaced from said combustion chamber front wall to define a combustion air inlet therebetween.

39. The fireplace of claim 38, wherein said combustion air inlet comprises a slot defined between said diverter plate and said combustion chamber front wall, and wherein said diverter plate is disposed at an obtuse angle to said combustion chamber top wall, whereby combustion products are directed towards said flue.

40. A direct vented, solid fuel burning fireplace operable at energy input levels greater than 75,000 BTU/hour, said fireplace installed in a building, and comprising:

an enclosure including a top wall, bottom wall and four side walls defining a combustion chamber, at least one of said side walls including an openable, sealed, transparent access door;

a flue connected to said enclosure and disposed in fluid communication with said combustion chamber and an outside ambient environment external to the building;

a combustion air duct connected to said enclosure and disposed in fluid communication with said combustion chamber and the outside ambient environment external to the building, wherein substantially all combustion air supplied to said combustion chamber flows through said combustion air duct when said access door is in a closed position; and a first plenum having an outlet leading to an interior of said flue and a second plenum having an outlet leading to an upper portion of said combustion chamber, each of said first and second plenums being fluidly connected to said combustion air duct;

said top wall including at least two openings, said first plenum disposed in fluid communication with one of said top wall openings and said second plenum disposed in fluid communication with the other of said top wall openings.

41. A direct vented, solid fuel burning fireplace operable at energy input levels greater than 75,000 BTU/hour, said fireplace installed in a building, and comprising:

an enclosure including a top wall, bottom wall, and four side walls defining a combustion chamber, at least one of said side walls including an openable, sealed, transparent access door;

a seal disposed between said access door and the combustion chamber;

a flue connected to said enclosure and disposed in fluid communication with said combustion chamber and an outside ambient environment external to the building; and a combustion air duct connected to said enclosure and disposed in fluid communication with said combustion chamber and the outside ambient environment external to the building, wherein said seal causes not less than 70 percent of all combustion air supplied to said combustion chamber to flow through said combustion air duct when said access door is in a closed position.

42. The fireplace of claim 41 further comprising an outer pipe around said flue, said combustion air duct disposed between said outer pipe and said flue.

43. The fireplace of claim 42 further comprising an intermediate pipe disposed between said outer pipe and said flue, said intermediate pipe and one of said outer pipe and said flue defining said combustion air duct therebetween.

44. The fireplace of claim 43, wherein said intermediate pipe and said outer pipe define said combustion air duct therebetween.

45. The fireplace of claim 41, wherein said top wall includes a plurality of openings therein, said combustion air duct in fluid communication with said openings.

46. The fireplace of claim 45, wherein some of said plurality of top wall openings are fluidly connected to said combustion chamber and carry combustion air into said combustion chamber and a remainder of said plurality of top wall openings are fluidly connected to an interior of said flue such that combustion air is drawn up said flue.

47. The fireplace of claim 41, further comprising a first plenum having an outlet disposed at or near the interior of said flue and a second plenum having an outlet disposed at the top of said combustion chamber, each of said first and second plenums fluidly connected to said combustion air duct.

48. The fireplace of claim 47, wherein said first plenum constitutes a means for inducing a flow of combustion air through said combustion air duct.

49. The fireplace of claim 48, wherein said first plenum induces a flow of combustion air through said combustion air duct, dependent on a flow rate of combustion products through said flue.

50. The fireplace of claim 47, wherein said first plenum outlet is disposed at an inlet to said flue.

51. The fireplace of claim 47, wherein said top wall includes a plurality of openings, said first plenum disposed below and in fluid communication with a portion of said top wall openings, said second plenum disposed below and in fluid communication with the remainder of said top wall openings.

52. The fireplace of claim 41, wherein said sealed access door allows a flow of combustion air into said combustion chamber and past said sealed access door at a rate of less than or equal to about 17.5 cubic feet per minute at a rate of pressure of 0.10 inch of water within said combustion chamber.

53. The fireplace of claim 41, wherein said sealed access door allows a flow of combustion air into said combustion chamber and past said sealed access door at a rate of between zero and 35 cubic feet per minute at a rate of pressure of 0.10 inch of water within said combustion chamber.

54. The fireplace of claim 41, wherein said sealed access door allows a maximum of 15 percent of a total amount of combustion air flowing into said combustion chamber to flow past said sealed access door.

* * * * *